US005454600A

United States Patent [19]

Floyd

[11] Patent Number: 5,454,600

[45] Date of Patent: Oct. 3, 1995

[54] PERSONAL IDENTIFICATION LABEL

[76] Inventor: Linda A. Floyd, P.O. Box 950, Buena Vista, Va. 24416

[21] Appl. No.: 341,862

[22] Filed: Nov. 15, 1994

[51] Int. Cl.[6] ..... B42D 15/04

[52] U.S. Cl. ..... 283/78; 283/117

[58] Field of Search ..... 283/68, 74, 75, 283/77, 78, 95, 106, 117

[56] References Cited

U.S. PATENT DOCUMENTS

| | | | |
|---|---|---|---|
| 1,459,634 | 6/1923 | Millen | 283/78 |
| 1,499,995 | 7/1924 | Stoddard . | |
| 1,746,955 | 2/1930 | Messer . | |
| 1,810,493 | 6/1931 | Messer | 283/78 |
| 3,419,287 | 12/1968 | Rudie | 283/78 X |
| 4,379,178 | 4/1983 | Meadows et al. | 427/1 |
| 4,650,219 | 3/1987 | Sigman | 283/70 |
| 4,699,077 | 10/1987 | Meadows et al. | 118/31.5 |
| 5,071,168 | 12/1991 | Shamos | 283/117 |
| 5,194,289 | 3/1993 | Butland | 427/1 |
| 5,330,231 | 7/1994 | Godfrey | 283/78 |

*Primary Examiner*—Willmon Fridie
*Attorney, Agent, or Firm*—Jacobson, Price, Holman & Stern

[57] ABSTRACT

A personal identification label includes a child-friendly image, scene or illustration on an iron-on label. The image depicts scenes, such as a rabbit in a field, dinosaurs walking through the woods, a horse jumping over a wall, or a dalmatian in front of a fire truck, for example. In any of the scenes depicted on the label, a fingerprint receiving space is left blank on the label and is contained entirely within the depicted scene or image. This special fingerprint receiving area is designed to include a fingerprint of a child. Once the fingerprint of the child is placed in the specific fingerprint receiving area in the scene, image or illustration depicted on the label, the lines of the fingerprint form an image which visually blends into the overall scene, illustration, or image for example, printed on the label.

9 Claims, 2 Drawing Sheets

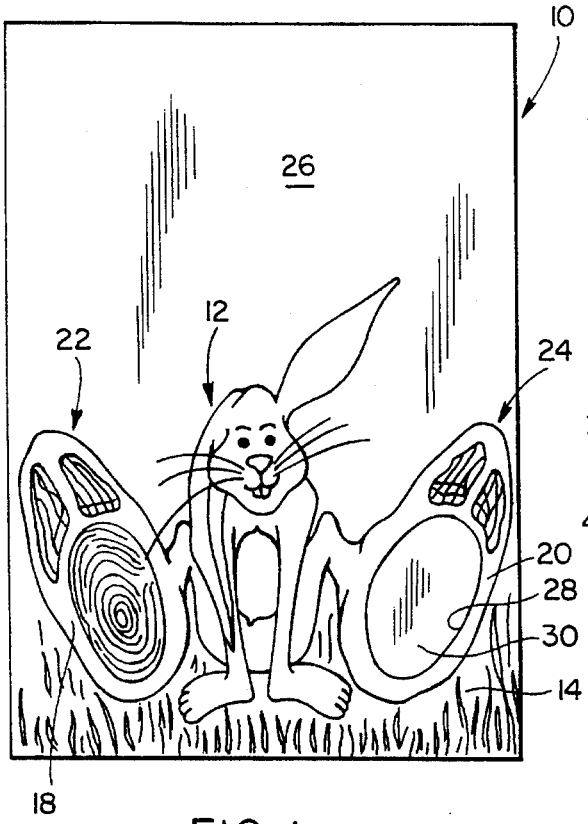
FIG. 1
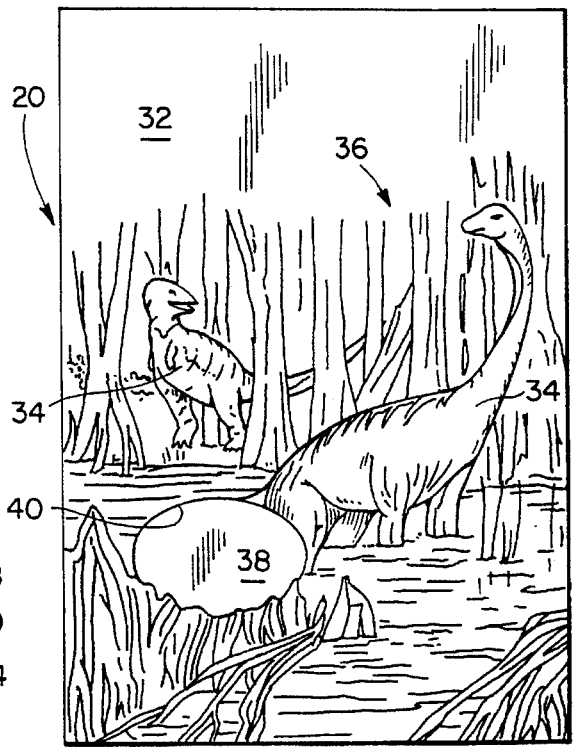
FIG. 2
FIG. 4
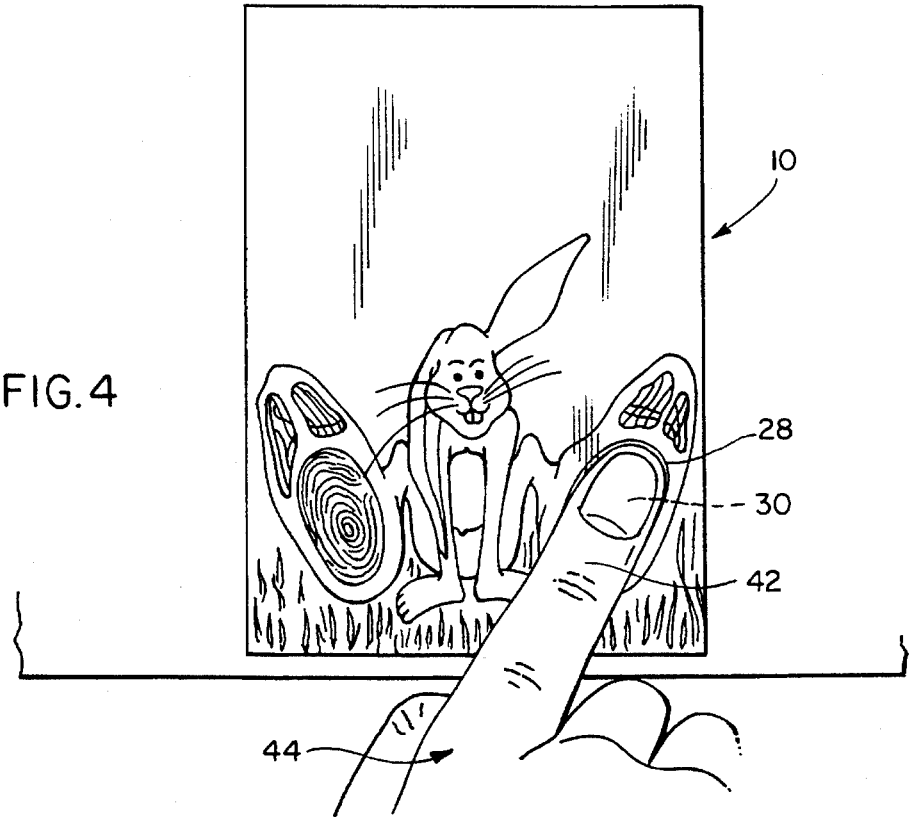

PERSONAL IDENTIFICATION LABEL

FIELD OF THE INVENTION

This invention relates to the field of personal identification labels for labelling an article of a child's clothing. The label includes a fingerprint of the child which is visually disguised and camouflaged by images on the label so that the appearance of the child's fingerprint on the label is not noticeable.

BACKGROUND OF THE INVENTION

An ever increasing problem of society has been the abduction of children. To assist in a search for missing children, it is essential that a method be devised to determine if an article of clothing uncovered during a search belongs to a missing child. This would greatly assist potential rescuers in providing clues to a potential location of a missing child by positively identifying an article of clothing or some other possession of a missing child.

Presently, there are different methods available of labelling an object for verification of ownership. These methods are disclosed in U.S. Pat. Nos. 1,499,955 to Stoddard; 1,746,955 to Messer; 4,650,219 to Sigman; 5,071,168 to Shamos; and 5,194,289 to Butland.

As indicated in these patents, one method of identifying an individual is through the use of fingerprints. Two methods for making a fingerprint marking are identified in U.S. Pat. Nos. 4,379,178 and 4,699,077 to Meadows et al. In these patents, fingerprint images are formed by applying a distal portion of a finger to a porous pad impregnated with a solution of marking compound. The finger is then applied to a fingerprint card impregnated with an aqueous solution of polyhydroxy developer. A fingerprint image immediately develops. This "inkless" system may be used for imprinting fingerprints of all the fingers in ten appropriately marked squares of a fingerprint identification card.

SUMMARY OF THE INVENTION

By the present invention, a personal identification label includes a child-friendly image, scene or illustration on an iron-on label. The image depicts scenes, such as a rabbit in a field, dinosaurs walking through the woods, a horse jumping over a wall, or a dalmatian in front of a fire truck, for example.

In any of the scenes depicted on the label, a fingerprint receiving space is left blank on the label and is contained entirely within the depicted scene or image. This special fingerprint receiving area is designed to include a fingerprint of a child. Once the fingerprint of the child is placed in the specific fingerprint receiving area in the scene, image or illustration depicted on the label, the lines of the fingerprint form an image which visually blends into the overall scene, illustration, or image for example, printed on the label.

For example, in an image of a dalmatian sitting before a fire truck, the fingerprint receiving area could form one of the wheels of the fire truck. Once an inked finger is placed in the location of the wheel of the fire truck, a fingerprint will be present which will appear to form the image of a wheel on the fire truck. The fingerprint is thereby disguised or camouflaged into the image, scene or illustration on the label so that the fingerprint is not noticeable on the label.

The label with the child's fingerprint is secured to an article of clothing, accessory or toy of the child by ironing, sewing, gluing, pasting or some other method. In the unfortunate instance when a child is lost, or for some reason does not return to their home, if an article of clothing, accessory or toy of the child is subsequently located with the personal identification label of the present invention attached thereto, an examination of the fingerprint on the label will be useful in providing clues as to the location of the child.

If a child is abducted, it is desired that the child abductors will not notice the fingerprint on the label on the personal identification label of the present invention and therefore, unwittingly, provide clues to the possible whereabouts of a missing child when a piece of the child's clothing or other accessory to which the personal identification label of the present invention has been attached, is discarded and subsequently located by a rescue team.

According to a preferred embodiment of the invention, the fingerprinting system used to impart a child's fingerprint to the personal identification label of the present invention, may be an "inkless" fingerprint system, as disclosed in U.S. Pat. Nos. 4,379,178 and 4,699,077, hereby incorporated in their entirety by reference. In this instance, the personal identification label will include a developer on its front face to produce a dark, distinct, permanent image when a finger of a child is applied to the label. The child's finger has previously been coated with a marking compound for transferring a non-visible latent image pattern to the label. Alternatively, an ink fingerprint system may be used, which merely requires that the ink be removed from the child's finger after a fingerprint has been imparted to the personal identification label of the present invention.

Accordingly, it is an object of the present invention to provide a personal identification label which includes an illustration which camouflages the fingerprint of a child so that casual inspection of the label does not reveal the presence of a fingerprint.

It is another object of the present invention to provide a personal identification label which includes an illustration which camouflages the fingerprint of a child so that casual inspection of the label does not reveal the presence of a fingerprint where the illustration is a child-friendly scene which is capable of being secured to children's clothing or accessories.

It is still yet another object of the present invention to provide a personal identification label which includes an illustration which camouflages the fingerprint of a child so that casual inspection of the label does not reveal the presence of a fingerprint where the illustration is a child-friendly scene which is capable of being secured to children's clothing or accessories with the label being formed of a material having a coating of developer for use in combination with an "inkless" fingerprint system.

These and other objects of the invention, as well as many of the intended advantages thereof, will become more readily apparent when reference is made to the following description taken in conjunction with the accompanying drawings.

BRIEF DESCRIPTION OF THE DRAWING

FIGS. 1 and 2 show two examples of illustrations which are printed on a personal identification label in accordance with the present invention.

FIG. 4 illustrates the application of a distal end of a finger wetted with a marking solution applied to a personal identification label in accordance with the present invention.

DETAILED DESCRIPTION OF THE PREFERRED EMBODIMENTS

Figure 3:
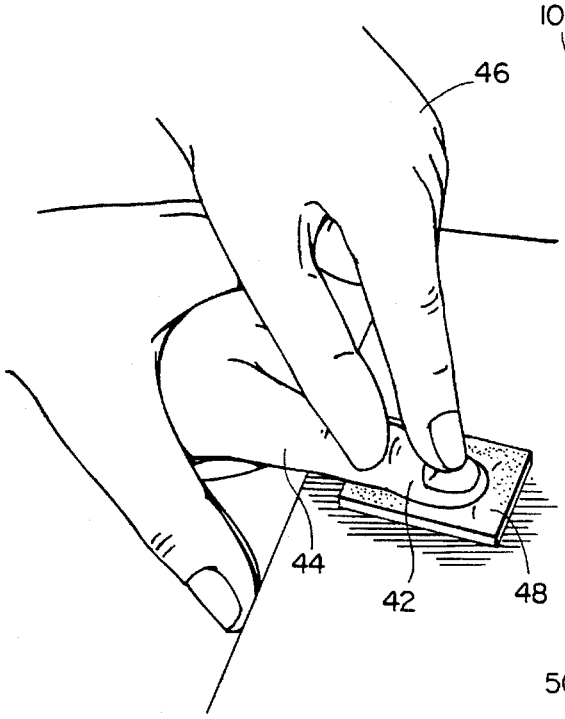
FIG. 3 illustrates the step of contacting a distal end of a finger with a marking solution.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

With reference to the drawings, in general, and to FIGS. 1 and 2, in particular, examples of a personal identification label embodying the teachings of the subject invention are generally designated as 10 and 20. With reference to its orientation in FIG. 1, the personal identification label 10 includes a rectangular piece of material, for example, made of fabric, plastic, or some other similar materials.

Illustrated on the label in the example shown in FIG. 1, is a rabbit 12 sitting in a field of grass 14 having the soles 18, 20 of its feet 22, 24, respectively, shown. It is understood that the specific illustration shown is for illustrative purposes only. It is contemplated that many different illustrations, scenes, images, indicia, or other printed matter will be included on the face of the personal identification label 10 in accordance with the teachings of the present invention.

A critical feature of the illustration on the face 26 of the label 10 is that there is an open, non-printed fingerprint receiving area, such as that depicted in FIG. 1 with an oval-shaped area 30 shown on the sole 20 of the foot 24 of the rabbit 12. The area within the outline 28 may be the color of the surface 26 of the label 10 prior to printing of an image on the label 10. In the example shown, it is intended that the area 30 within the border 28 is of a white color. Alternatively, it is possible that the fingerprint receiving area is a colored surface, however, it is preferable that the fingerprint receiving area be devoid of illustration, such as to provide a clear area for receiving a fingerprint.

In an alternative exemplary illustration shown on the face 32 of label 20, two dinosaurs 34 are shown walking through a forest 36. A non-printed area 38, bordered by an elliptical border 40, includes a white color or color of the non-printed label prior to printing of the label 20. In the example of FIG. 2, the area 38 is equivalent to the area 30 in FIG. 1.

The face 26, 30 of the labels 10 and 20, respectively, includes a coating of developer either prior to or after printing of the labels 10 or 20. The areas 30, 38 are a fingerprint receiving portion of the label impregnated with developer so that a fingerprint pattern is imparted to the areas 30, 38 of the labels 10, 20, respectively by an "inkless" printing system. It is understood that an ink fingerprint system may also be used.

If an inkless fingerprinting system is used, with reference to FIG. 3, the distal end 42 of a child's finger 44 is moved by an adult's hand 46 to engage a pad 48 including a marking solution. The material of pad 48 is inert to the marking solution. The wetted and moistened distal end 42 of the child's finger 44, is then applied to the fingerprint receiving portion 30, 38 of either of the labels 10 or 20, for example, however, with reference to FIG. 4, the label of FIG. 1 is shown.

A similar procedure is used with an ink printing system. A cloth for cleaning the finger of the child is provided, using either an ink or inkless system.

Figure 5:
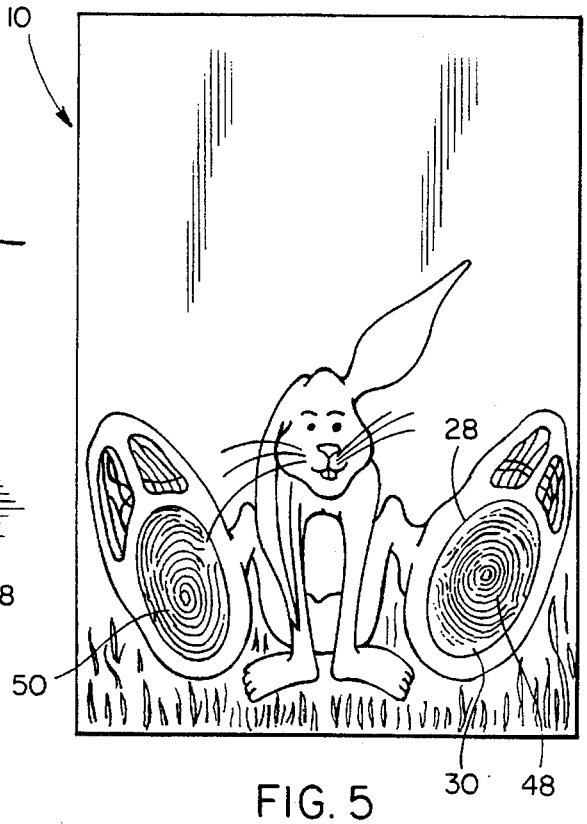
FIG. 5 illustrates the camouflaged fingerprint of a child included on the personal identification label in accordance with the present invention.

Upon removal of the distal end of the child's finger from the label 10 as shown in FIG. 5, a fingerprint 48 is formed in the fingerprint receiving portion 30 bounded by border 28. Upon initial inspection, the fingerprint 48 on the sole 20 of the foot 24 of the rabbit appears similar to the printed pattern 50 appearing on the sole 18 of the foot 22 of the rabbit. This similar appearance between a fingerprint on the label and a printed portion of the label serves to camouflage the fingerprint in the illustration included on the label 10.

Similarly, the background printed onto the label, such as, for example, on label 20, is such that a fingerprint receiving portion will disguise or camouflage a fingerprint within the illustration included on the label 20. In label 20, a fingerprint applied onto fingerprint receiving portion 38 will produce the appearance of a dinosaur egg lying in some brush in a forest. The ridge endings and ridge bifurcations of a fingerprint pattern will seem to form a texture of a dinosaur egg and thereby be camouflaged or disguised within the illustration included on label 20.

As previously discussed, an infinite array of illustrations, images, scenes, etc. may be formed on the personal identification label in accordance with the present invention, however, they would all include in common a fingerprint receiving portion which, once a fingerprint is applied, will blend in with the surrounding scene so as to disguise or camouflage the fingerprint.

Figure 6:
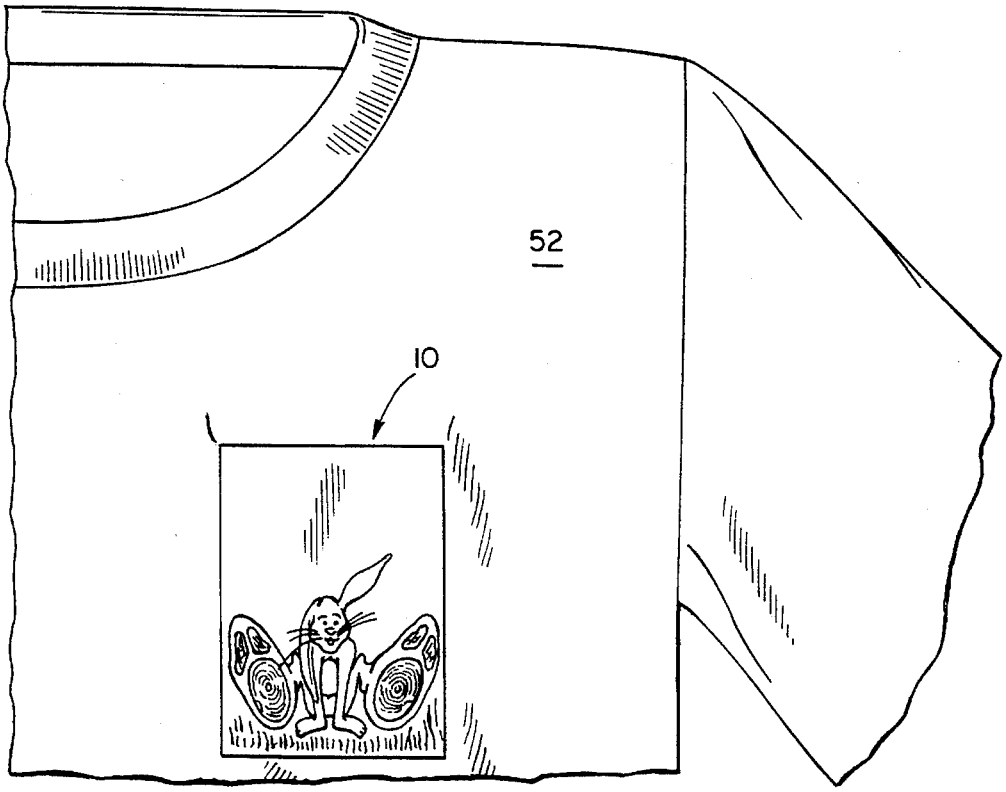
FIG. 6 illustrates a personal identification label in accordance with the present invention secured to an article of clothing.

Once a fingerprint is applied to the label, the label may be applied to an article of clothing, such as a shirt 52, for example, as shown in FIG. 6, which may be placed in a conspicuous location as shown in FIG. 6, or on an interior, inconspicuous surface of an article of clothing or accessory of a child. It is intended that a visual inspection of the personal identification label of the present invention would not cause someone to notice anything irregular or conspicuous about the label, much less easily identify the presence of a fingerprint on the label. Accordingly, if an article of clothing or accessory of a child having the personal identification label of the present invention is discovered, a child's identification may be determined by the fingerprint on the label and possibly provide assistance in locating the child. It is understood that a record of the child's fingerprint would be retained separate from the label of the present invention for comparison purposes with the fingerprint located on the personal identification label of the present invention.

Having described the invention, many modifications thereto will become apparent to those skilled in the art to which it pertains without deviation from the spirit of the invention as defined by the scope of the appended claims.

I claim:

1. A personal identification label assembly comprising the combination of:

a sheet of material, said sheet of material containing an illustration, a fingerprint receiving portion of said sheet of material being located in said illustration for receiving a fingerprint, and means for printing a fingerprint on said fingerprint receiving portion, said fingerprint being camouflaged in said illustration to appear as a part of said illustration when said fingerprint is applied to said fingerprint receiving portion.

2. A personal identification label assembly according to claim 1, wherein said illustration is included on a front face of said sheet of material.

3. A personal identification label assembly according to claim 2, wherein a rear face of said sheet of material includes means for securing said sheet of material to an article of clothing or object.

4. A personal identification label assembly according to claim 1, wherein a front face of said sheet of material includes a developer at least at said fingerprint receiving portion.

5. A personal identification label assembly according to claim 1, wherein said illustration is absent from said fingerprint receiving portion.

6. A personal identification label comprising:

a sheet of material having a front face and a rear face, an illustration located on said front face, and a fingerprint receiving portion located in said illustration including an area for receipt of a fingerprint so that said fingerprint visually blends into and is camouflaged by said illustration so as to appear as being a part of said illustration.

7. A personal identification label according to claim 6, wherein said rear face includes means for securing said sheet of material.

8. A personal identification label according to claim 6, wherein said illustration is absent from said fingerprint receiving portion.

9. A personal identification label according to claim 6, wherein said front face includes a developer at least at said fingerprint receiving portion.

* * * * *